US010359211B2

(12) United States Patent
Mori et al.

(10) Patent No.: US 10,359,211 B2
(45) Date of Patent: Jul. 23, 2019

(54) REFRIGERATION AND AIR CONDITIONING DEVICE

(71) Applicant: Hitachi-Johnson Controls Air Conditioning, Inc., Tokyo (JP)

(72) Inventors: Hayato Mori, Tokyo (JP); Shuntaro Inoue, Tokyo (JP); Shoutaro Yamamoto, Tokyo (JP); Katsuaki Nagahashi, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/756,465

(22) PCT Filed: Aug. 10, 2016

(86) PCT No.: PCT/IB2016/054797

§ 371 (c)(1),
(2) Date: Feb. 28, 2018

(87) PCT Pub. No.: WO2017/042647

PCT Pub. Date: Mar. 16, 2017

(65) Prior Publication Data

US 2018/0266723 A1 Sep. 20, 2018

(30) Foreign Application Priority Data

Sep. 10, 2015 (JP) ..... 2015-178500

(51) Int. Cl.
*F24F 1/00* (2019.01)
*F24F 1/50* (2011.01)
(Continued)

(52) U.S. Cl.
CPC ..... *F24F 13/20* (2013.01); *F24F 1/00* (2013.01); *F24F 1/50* (2013.01); *F24F 5/00* (2013.01); *F24F 13/24* (2013.01); *F24F 13/32* (2013.01)

(58) Field of Classification Search
CPC ..... F24F 1/06; F24F 1/18; F24F 1/46; F24F 13/20; F24F 1/32; F24F 1/325; F24F 1/48; B21D 53/085
See application file for complete search history.

(56) References Cited

U.S. PATENT DOCUMENTS 4,736,598 A * 4/1988 Sameshima ..... F24F 1/022 62/259.1
2008/0250806 A1* 10/2008 Hayashida ..... F24F 1/18 62/259.1

(Continued)

FOREIGN PATENT DOCUMENTS

CN 101592366 A 12/2009
CN 204084674 U 1/2015

(Continued)

OTHER PUBLICATIONS

International Search Report of PCT/IB2016/054797 dated Dec. 21, 2016.

(Continued)

*Primary Examiner* — Elizabeth J Martin
(74) *Attorney, Agent, or Firm* — Mattingly & Malur, PC

(57) ABSTRACT

A refrigeration and air conditioning device, which is an outdoor unit of a refrigeration and air conditioning device provided with a heat exchanger within a housing (2) and blowers (3) arranged on the housing, the housing (2) being provided with a side cover covering the sides, a base (9) covering the bottom and a foot portion (10) arranged below the base (9), the foot portion (10) being provided with a raised portion (10*b*) upwardly bending an end face (10*c*) of (Continued)

a lower surface of the foot portion. The refrigeration and air conditioning device increases rigidity without increasing costs.

6 Claims, 6 Drawing Sheets

(51) Int. Cl.

| | |
|---|---|
| ***F24F 5/00*** | (2006.01) |
| ***F24F 13/20*** | (2006.01) |
| ***F24F 13/24*** | (2006.01) |
| ***F24F 13/32*** | (2006.01) |

(56) References Cited

U.S. PATENT DOCUMENTS

| | | | | |
|---|---|---|---|---|
| 2009/0108717 | A1* | 4/2009 | Jang | F24F 1/38 312/100 |
| 2011/0073746 | A1 | 3/2011 | Padiotis | |
| 2014/0224457 | A1 | 8/2014 | Suzuki et al. | |
| 2015/0040446 | A1* | 2/2015 | Nakasu | F24F 1/06 40/625 |
| 2015/0040609 | A1 | 2/2015 | Yamauchi et al. | |
| 2017/0314791 | A1* | 11/2017 | Yanase | F24F 1/36 |

FOREIGN PATENT DOCUMENTS

| | | | |
|---|---|---|---|
| EP | 2 056 029 | A2 | 5/2009 |
| JP | 2-38023 | U | 3/1990 |
| JP | 3-194334 | A | 8/1991 |
| JP | 2007-303789 | A | 11/2007 |
| JP | 2007-309632 | A | 11/2007 |
| JP | 08-86474 | A | 12/2016 |
| WO | 01/65184 | A2 | 9/2001 |
| WO | 2013/046724 | A1 | 4/2013 |

OTHER PUBLICATIONS

Extended European Search Report received in corresponding European Application No. 16843746.5 dated Mar. 21, 2019.
Japanese Office Action received in corresponding Japanese Application No. 2015-178500 dated Jun. 4, 2019.

* cited by examiner

A-A ENLARGED VIEW B-B ENLARGED VIEW C SIDE VIEW

REFRIGERATION AND AIR CONDITIONING DEVICE

TECHNICAL FIELD

The present invention relates to the improvement in strength and rigidity of an outdoor unit of a refrigeration and air conditioning device.

BACKGROUND ART

Refrigeration and air conditioning devices such as air conditioning systems for multistory buildings and compact refrigerating machines generally employ a moderately large top-blown type outdoor unit having a blower mounted atop.

The background art related to this type of outdoor unit of refrigeration and air conditioning device is set forth in Japanese Patent Application Laid-Open No. 2007-309632 (Patent Literature 1), for example. The Patent Literature 1 discloses an outdoor unit of air conditioner, which includes: a bottom base; a heat exchanger disposed on this bottom base; a shroud opposed to the bottom base; and a blower including a propeller fan surrounded by this shroud and a motor for driving the propeller fan.

The outdoor unit having such a configuration is often mounted on a stand installed on a building rooftop. In this case, the background art of an outdoor-unit foot structure for fastening the bottom base of the outdoor unit to the stand is set forth in Japanese Patent Application Laid-Open No. 2007-303789 (Patent Literature 2), for example. The Patent Literature 2 addresses strength against lateral load with the aim of increasing the rigidity of a mount foot as an outdoor-unit foot portion. The Patent Literature 2 discloses the mount foot including: a top plate portion fixed to a bottom plate; a bottom plate portion opposed to the top plate portion and fixed to an installation surface; and a raised plate portion connecting an inner edge portion of the bottom plate portion and an inner edge portion of the top plate portion in opposed relation to the bottom plate portion. The raised plate portion includes: a vertical plate portion connected to the top plate portion; and tilted plate portions extended from a lower end of the vertical plate portion in a direction away from each other and connected to the bottom plate portion.

CITATION LIST

Patent Literature

Patent Literature 1: Japanese Patent Application Laid-Open No. 2007-309632

Patent Literature 2: Japanese Patent Application Laid-Open No. 2007-303789

SUMMARY OF INVENTION

Technical Problem

The top-blown type outdoor unit of air conditioner disclosed in the above Patent Literature 1 has a structure which includes: the bottom base for mounting the heat exchanger and principal refrigerating device; and a foot portion under the bottom base. In a case where a contact area between the foot portion and the stand is small, the foot portion suffers rigidity insufficiency which adversely affects vibration and noise problem. Further, this structure is problematic in terms of visual appearance.

On the other hand, the Patent Literature 2 discloses the structure designed to increase the rigidity of the mount foot against the lateral load. However, this literature does not consider the following problems. The foot portion of the outdoor unit has such a small area of contact with the stand that the foot portion is prone to sag under the weight of the unit itself. This leads to the deterioration of visual appearance. Further, the deformability of the structure involves fear of increase in vibrations and noises. In a case where reinforcement members are unduly added as an improvement measure, the amount of material used for a housing is increased, resulting in cost increase. Hence, there is a demand for a technique for forming the housing increased in rigidity while reducing the used amount of material and achieving cost reduction. An arrangement where the reinforcement member is disposed in vicinity of the heat exchanger is unfavorable because the reinforcement member may interfere with air flow.

In view of the above, an object of the invention is to provide an outdoor unit of refrigeration and air conditioning device, in which some of the existing components is enhanced in the function of reinforcement member for increasing the strength and rigidity in order to reduce the vibrations and noises of the outdoor unit and to ensure the reliability thereof while eliminating the causes of cost increase and air flow interference.

Solution to Problem

According to an aspect of the invention for achieving the above object, an outdoor unit of refrigeration and air conditioning device includes a heat exchanger accommodated in a housing, and a blower disposed atop the housing, and has an arrangement wherein the housing includes: a side cover for covering sides of the outdoor unit; a bottom base for covering a bottom of the outdoor unit; and a foot portion disposed under the bottom base, and the foot portion includes a raised portion formed by bending upward an underside end of the foot portion.

Advantageous Effects of Invention

The invention can achieve an effect to increase the rigidity of the foot portion without entailing cost increase, because the foot portion can be increased in the second moment of area on the basis of the same amount of material used.

DESCRIPTION OF EMBODIMENTS

The embodiments of the invention will hereinbelow be described with reference to the accompanying drawings.

First Embodiment

An outdoor unit of refrigeration and air conditioning device according to this embodiment of the invention is designed to ensure the rigidity thereof when the outdoor unit is installed on a stand. To clarify the embodiment, a structure of the outdoor unit is first described with reference to a fundamental arrangement of a general outdoor unit.

Figure 1:
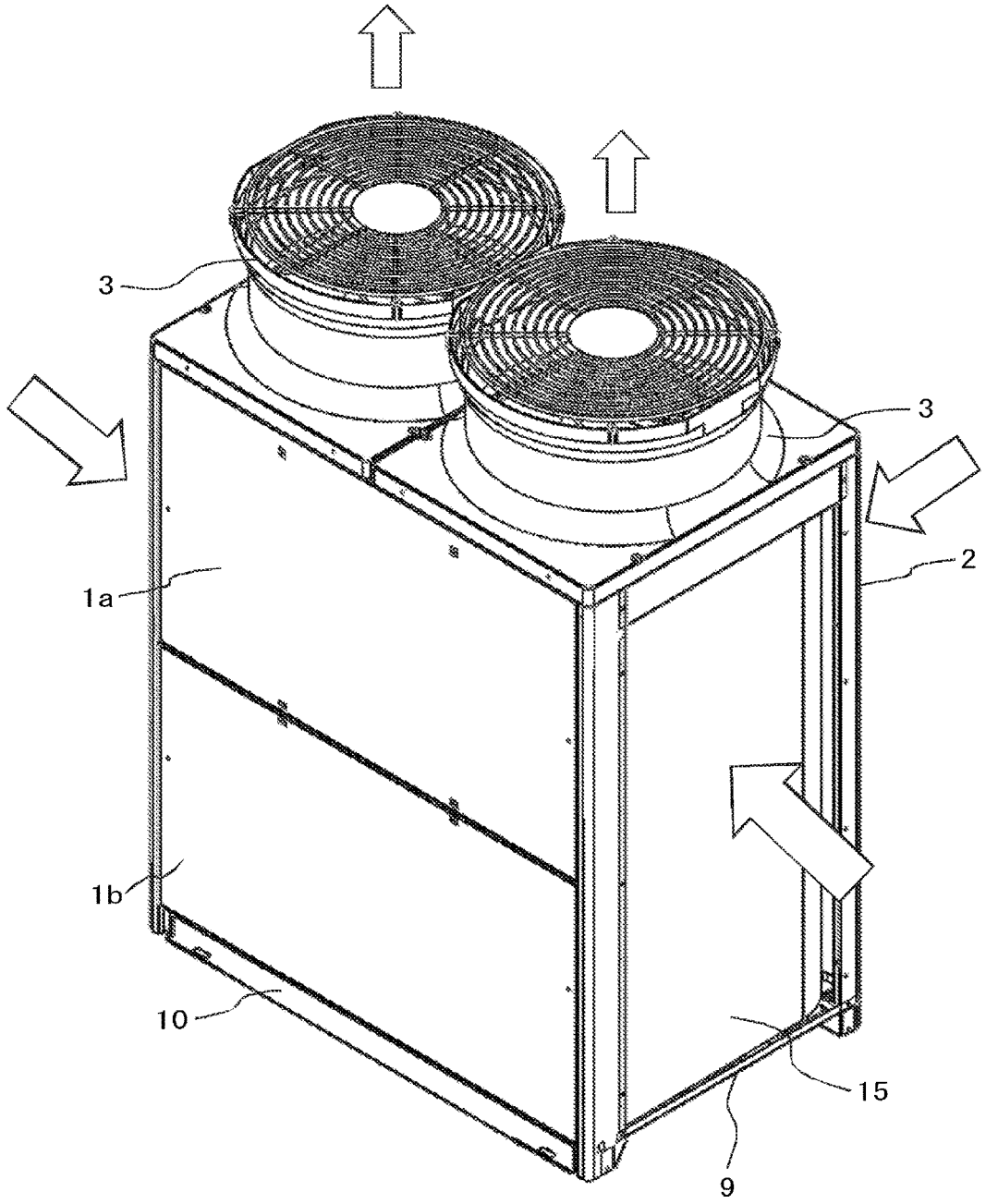
FIG. 1 is an external view of an outdoor unit of air conditioner according to a first embodiment hereof.

FIG. 1 is an external view of an outdoor unit of air conditioner as one type of refrigeration and air conditioning device. An outdoor unit housing 2 as a housing of the outdoor unit includes: maintenance panels 1*a*, 1*b* permitting maintenance work; an unillustrated side cover for covering sides of the unit; a bottom base 9 for covering a bottom of the unit; and a foot portion 10 disposed under the bottom base 9. The side cover includes a plurality of air inlet ports on lateral sides and a rear side of the housing. Provided with a blower 3 atop, the outdoor unit is configured to blow out air from a top side thereof. Accordingly, the air flows as indicated by arrows in the figure.

Figure 2:
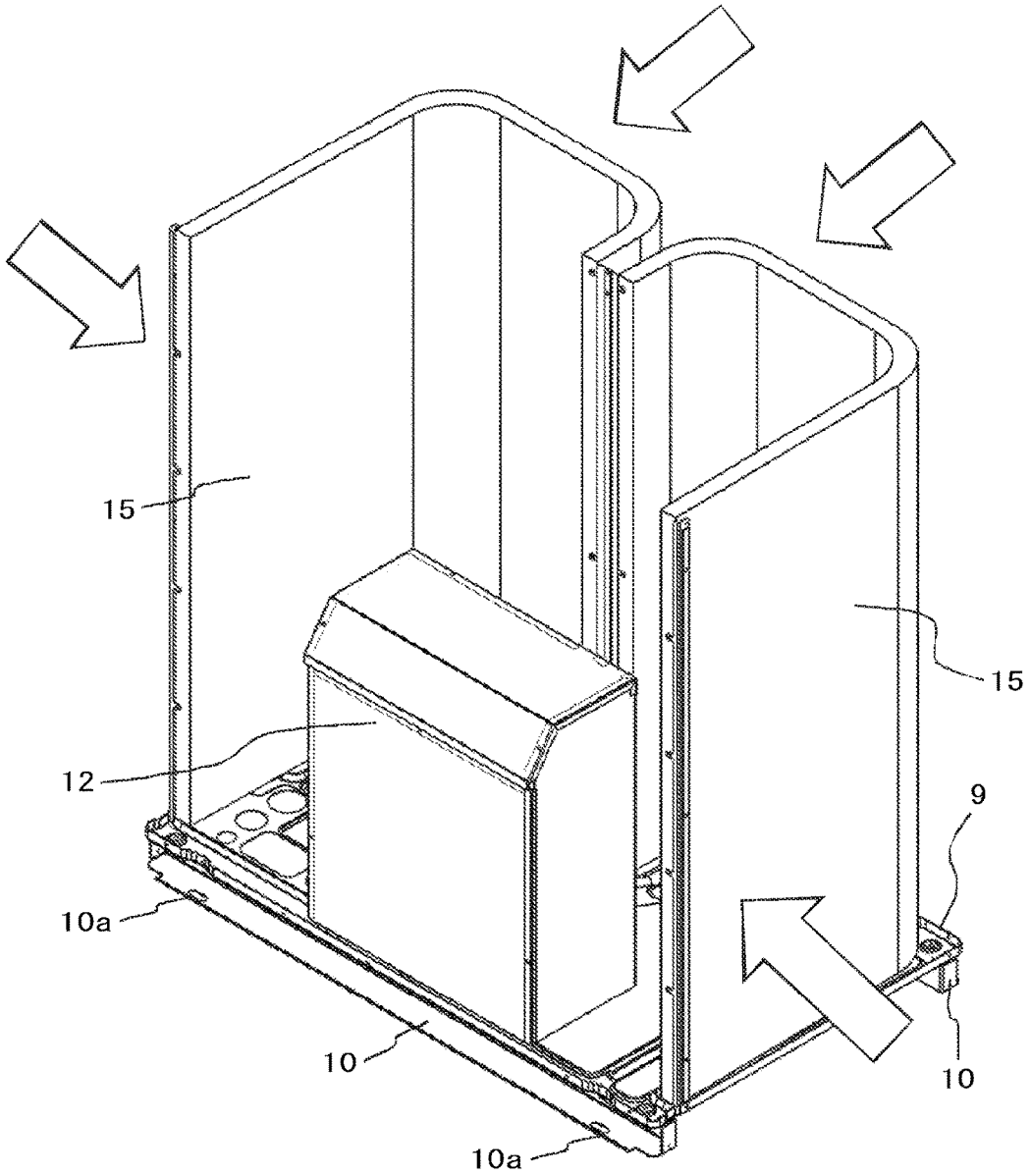
FIG. 2 is an internal structure diagram of the outdoor unit according to the first embodiment hereof.

The outdoor unit as described above has an internal structure as shown in FIG. 2. Referring to FIG. 2, the outdoor unit housing 2 includes a machine room 12 which includes devices such as a heat exchanger 15 and a compressor, and the bottom base 9 for mounting an unillustrated refrigeration cycle device. A space under the bottom base 9 may preferably accommodate refrigerant circuit, electric wiring and drain hose layout. Normally, the outdoor unit housing 2 includes the foot portion 10 under the bottom base 9 such that the bottom base 9 is not in direct contact with the ground.

Figure 3:
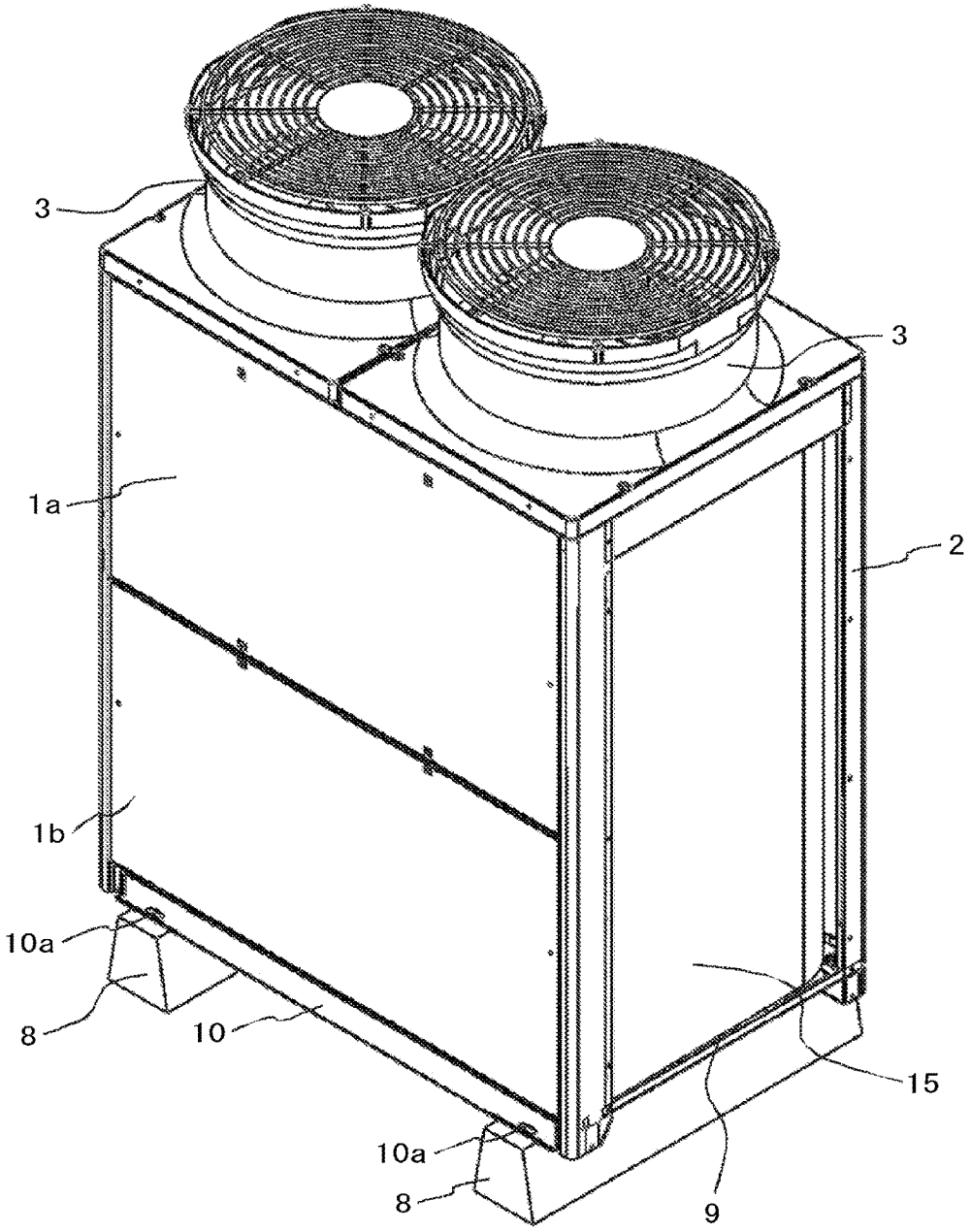
FIG. 3 is a diagram showing an installed state of the outdoor unit according to the first embodiment hereof.

In a case where the whole bottom surface of the foot portion 10 is in contact with and fixed to the ground, the problem of vibrations and noises is eliminated because the foot portion 10 provides the space allowing for the piping layout and is rigidly anchored to the ground. However, a case where the foot portion is set on the ground involves fear that the outdoor unit may be partially submerged when the amount of rainfall is extremely high. In most cases, therefore, the outdoor unit is installed in a manner that the outdoor unit housing 2 is raised from the ground via a concrete stand 8, as shown in FIG. 3. In this case, the foot portion 10 includes bolt tightening points 10*a* as fixed portion to the stand 8 such that the foot portion is fixed to the stand 8 with bolts. The foot portion is in contact with the stand 8 only at about four bolt tightening points 10*a* so that the foot portion is prone to flexure at the center thereof.

Figure 4:
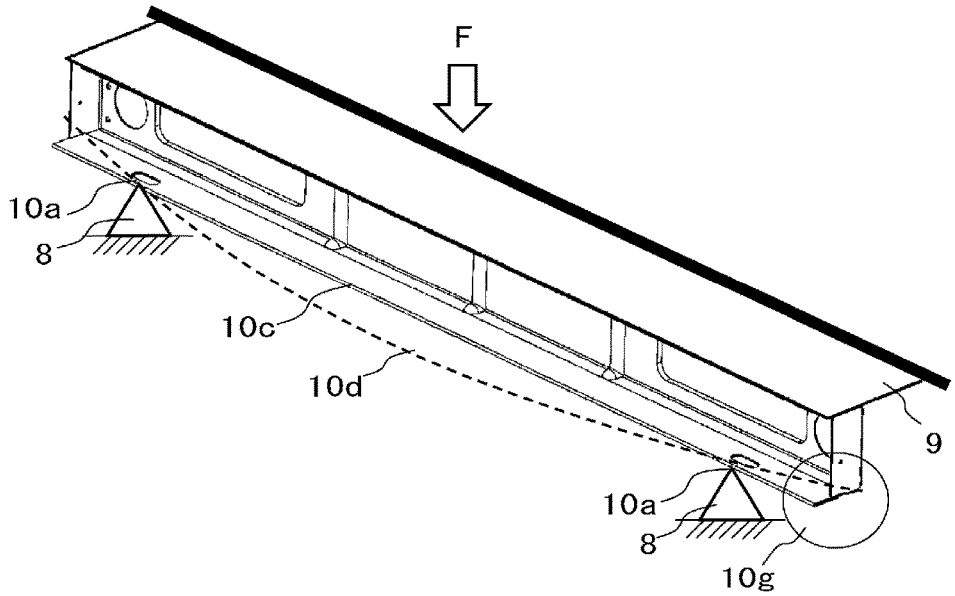
FIG. 4 is a perspective view showing a conventional foot portion of the outdoor unit.

FIG. 4 is a perspective view showing a conventional foot portion. Under a force F produced by the weight of the outdoor unit, an underside end 10*c* of the foot portion 10 is so deformed as represented by a deformity 10*d*.

Figure 5:
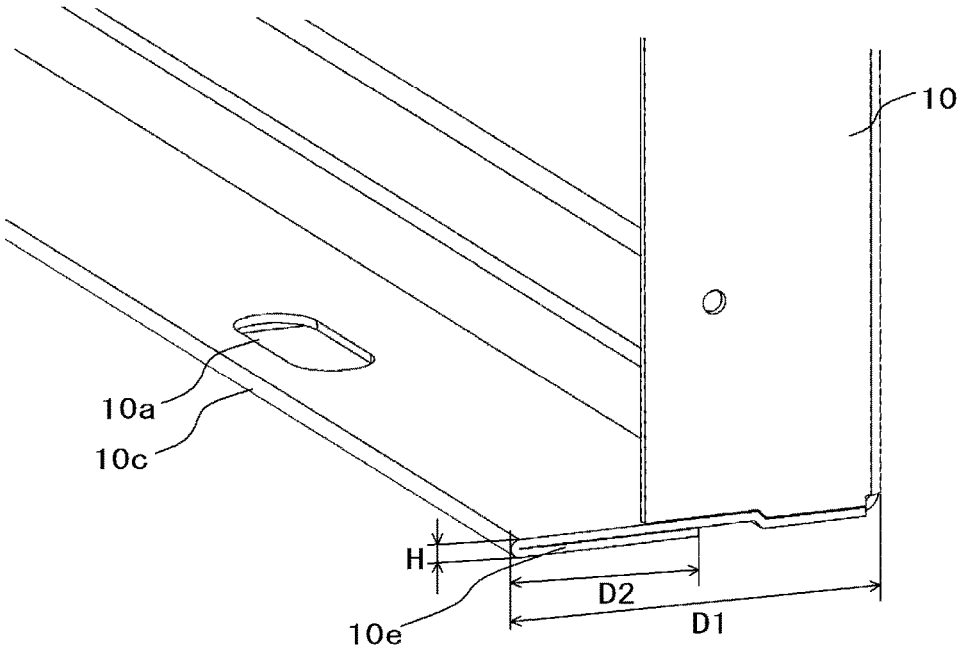
FIG. 5 is an enlarged view of a portion in FIG. 4.

FIG. 5 shows a portion 10*g* in FIG. 4 in enlarged dimension. In order to prevent the deformity as illustrated by FIG. 4, the underside end 10*c* of the foot portion can be hemmed (folded) into a shape 10*e* such that the rigidity is ensured by doubling the thickness of the bottom plate. Nonetheless, there may be a case where the foot portion is prone to deformation as a result of insufficient rigidity. Unfortunately, a measure to simply increase the thickness of the underside of the foot portion or to apply an additional member thereto leads to cost increase.

In view of the above, the embodiment has been accomplished and an object thereof is to provide a foot portion capable of obviating cost increase while ensuring a sufficient rigidity when the outdoor unit is installed on the stand.

Figure 6A:
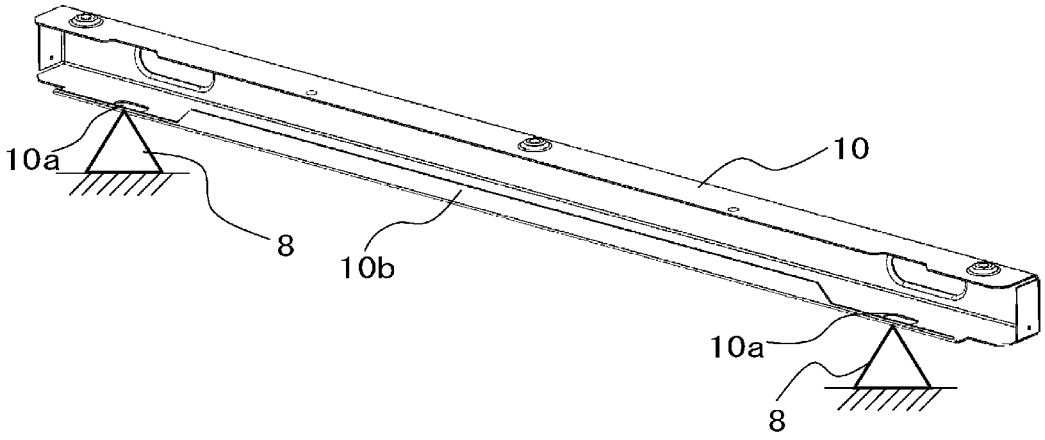
FIG. 6A is a perspective view of a foot portion of the outdoor unit according to the first embodiment hereof.

In this embodiment, the foot portion has a structure shown in FIG. 6A. The foot portion 10 is centrally formed with a raised portion 10*b* on the underside end thereof. The raised portion is diminished in height only at an area around the bolt tightening point 10*a*. This configuration can effectively suppress the flexure of the foot portion when the outdoor unit is installed on the stand because the foot portion is increased in the second moment of area due to the effect of raising the end. As compared with the case where the end of the foot portion is hemmed, the foot portion is more increased in the second moment of area on the basis of the same amount of material used. Hence, this structure can achieve the effect of suppressing the flexure without entailing cost increase.

Figure 6B:
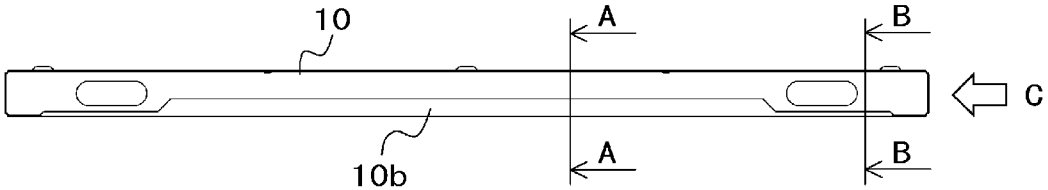
FIG. 6B is a front view of the foot portion of the outdoor unit according to the first embodiment hereof.
Figure 6C:
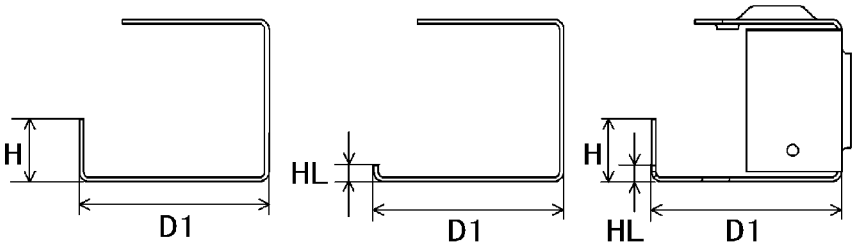
FIG. 6C is a group of fragmentary sectional views and a side view of portions in FIG. 6B.

Details of the structure diagram of the foot portion of the outdoor unit according to the embodiment are described with reference to FIG. 6A, FIG. 6B and FIG. 6C.

FIG. 6A is a perspective view of the foot portion of the outdoor unit according to the embodiment. Referring to FIG. 6A, the foot portion includes the raised portion 10*b* formed by bending upward the underside end 10*c* of the foot portion. The raised portion 10*b* is so formed as to have the greatest height at the center between the fixed portions of the foot portion but the smaller height at the fixed portions. Namely, the raised portion 10*b* has a structure where the height at the area around the bolt tightening point 10*a* is lower than the height at an intermediate portion between the two bolt tightening points 10*a* of the foot portion 10. FIG. 6B is a front view of the foot portion of FIG. 6A. FIG. 6C includes sectional views taken on the line A-A and the line B-B in FIG. 6B and a side view as seen from a direction C. As shown in FIG. 6C, the raised portion 10*b* has a height H at the center between the bolt tightening points 10*a* and a height HL on the line B-B at the area around the bolt tightening point 10*a*. These heights have a relation of H>HL because of the following reason. The bolt at the bolt tightening point 10*a* is tightened with a tool. If the raised portion 10*b* at the bolt tightening point 10*a* is as high as the raised portion at the center between the bolt tightening points, the raised portion 10*b* at the bolt tightening point interferes with the tightening work, lowering the work efficiency. Hence, the raised portion at the area around the bolt tightening point 10*a* is diminished in height. The raised portion at the area around the bolt tightening point 10*a* may preferably have a height, for example, equivalent to the thickness of a washer applied when the bolt is tightened. Since the raised portion 10*b* contributes to the increase of the second moment of area in the height direction, the flexure of the foot portion when the outdoor unit is installed on the stand can be effectively suppressed. At the bolt tightening point 10*a*, on the other hand, the foot portion is in contact with the stand 8 and hence, the foot portion sustains less flexure in the vicinity of the bolt tightening point 10*a*. Accordingly, the effect to suppress the flexure of the whole body of the foot portion is little affected if the raised portion is diminished in height only in the area around the bolt tightening point 10*a*.

A specific example of the embodiment is described. As to the conventional structure of the foot portion shown in FIG. 5, the central deformity 10*d* of the underside end of the foot portion exhibits a flexure amount of about 3 mm, provided that a longitudinal dimension W of the bottom of the foot portion is 1200 mm, a crosswise dimension D1 of the bottom thereof is 70 mm, a fold dimension D2 is 35 mm, a steel sheet thickness of the foot portion is 1.6 mm and a mass of the outdoor unit is 350 kg. Further, a material having a dimension of about 105 mm (D1+D2) is used for the underside of the foot portion 10. According to the structure diagram of the foot portion of the embodiment as shown in FIG. 6A, on the other hand, a longitudinal dimension W of the bottom of the foot portion is 1200 mm, a crosswise dimension D1 of the bottom of the foot portion is 70 mm, and a height dimension H of the raised portion is 23 mm. Similarly to the conventional foot portion described above, a steel sheet thickness of the foot portion is 1.6 mm and a mass of the outdoor unit is 350 kg. In this case, the central deformity of the underside end of the foot portion exhibits a flexure amount of about 1.8 mm. That is, the foot portion achieves 40 percent improvement in the rigidity. Further, the dimension D1+D2 of the foot portion 10 can be reduced to about 93 mm in comparison to the calculated example D1+D2=105 mm, indicating the reduction of the used amount of material and cost.

In the case of the structure shown in FIG. 6A, a ratio of the height dimension H of the raised portion to the crosswise dimension D1 of the bottom of the foot portion is 23/70≈33%. Realistically speaking, if a dimensional ratio of the raised portion is on the order of 30%, the foot portion can be reduced in the used amount of material while achieving some degree of rigidity improvement. On the other hand, if the used amount of material is not reduced but the same amount of material is used as that used according to D1+D2=105 mm shown in FIG. 5, dimension values H=35 mm, D1=70 mm are obtained. A rate of H to D1 is 35/70=50%. This means that a structure made from the same amount of material is increased in rigidity. If more importance is put on the rigidity and dimension values are defined as H=35 mm and D1=58 mm, the ratio of H to D1 is 35/58≈60%. The foot portion can achieve still higher rigidity while reducing the used amount of material. Although it is possible to further increase the dimensional ratio of the height of the raised portion to above 60%, the greater the height of the raised portion, the greater the used amount of material. Therefore, the value H cannot be unduly increased in consideration of the effect to reduce the used amount of material. Further, the crosswise dimension D1 of the bottom of the foot portion cannot be reduced unlimitedly because of various matters related to the execution of works such as bolt hole size and space for work using tools. In consideration of a balance between these factors, it is desirable to limit the numerical value of the height H of the raised portion to 60% or less of the crosswise dimension D1 of the bottom of the foot portion.

As described above, the embodiment pertains to the outdoor unit of refrigeration and air conditioning device, which unit includes the heat exchanger accommodated in the housing and the blower disposed atop the housing. The housing includes: the side cover for covering the sides of the unit; the bottom base for covering the bottom of the unit; and the foot portion disposed under the bottom base. The foot portion includes the raised portion formed by bending upward the underside end of the foot portion.

The foot portion further includes a plurality of portions fixed to the stand. The raised portion is so configured as to have the greater height at the center between the fixed portions of the foot portion but the smaller height at the fixed portions.

This configuration of the foot portion is adapted to increase the rigidity and strength of the outdoor-unit housing without adding any more additional component to the housing. This configuration is also excellent in terms of cost performance because the additional component is not required. Namely, this embodiment is adapted to increase the second moment of area based on the same used amount of material and hence, can achieve the effect to increase the rigidity of the foot portion without entailing cost increase.

Second Embodiment

This embodiment illustrates another example of the structure of the foot portion. A structure of the foot portion of the outdoor unit according to this embodiment is shown in FIG. 7A, FIG. 7B and FIG. 7C.

Figure 7A:
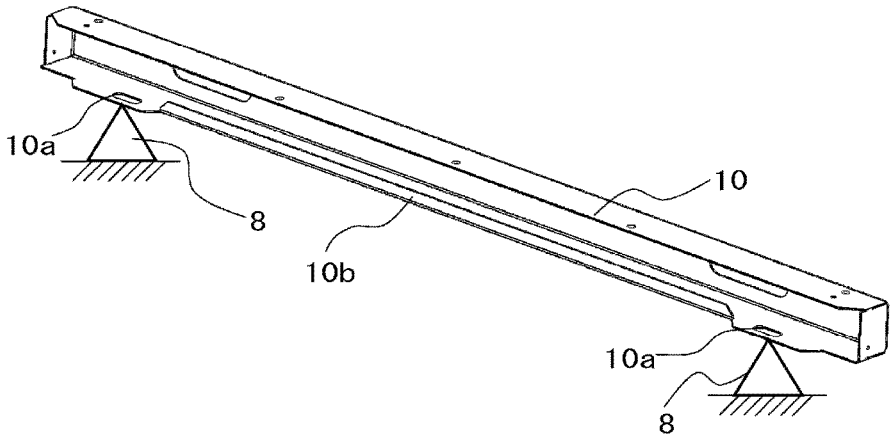
FIG. 7A is a perspective view of a foot portion of an outdoor unit according to a second embodiment hereof.

FIG. 7A is a perspective view of a foot portion of an outdoor unit according to this embodiment. Referring to FIG. 7A, the foot portion 10 is formed with the raised portion 10*b* at the center between the two bolt tightening points 10*a*. The foot portion has a structure where the raised portion 10*b* does not exist in the area around the bolt tightening point 10*a*. Specifically, the foot portion is formed with the raised portion 10*b* at the center between the bolt tightening points 10*a* by bending up a corresponding portion of the underside end 10*c* of the foot portion, while a portion of the underside end thereof in the area around the bolt tightening point 10*a* is not bent up but left as it is.

Figure 7B:
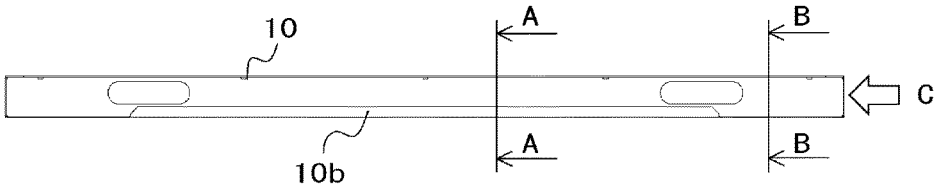
FIG. 7B is a front view of the foot portion of the outdoor unit according to the second embodiment hereof.
Figure 7C:
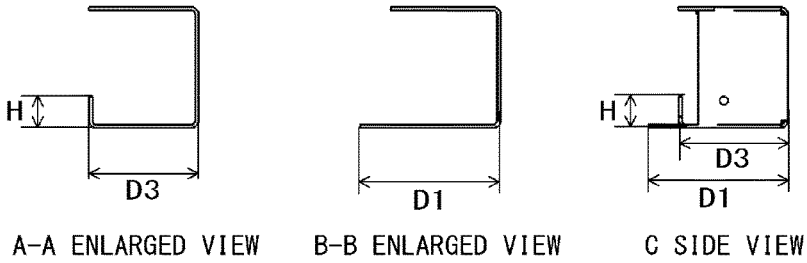
FIG. 7C is a group of fragmentary sectional views and a side view of portions in FIG. 7B.

FIG. 7B is a front view of the foot portion of FIG. 7A, while sectional views of the foot portion taken on the line A-A and the line B-B, and a side view thereof are shown in FIG. 7C. As shown in FIG. 7C, a raised portion 10*b* at the center between the bolt tightening points 10*a* has a height H, while a raised portion on the line B-B in the area around the bolt tightening point 10*a* has height zero. Thus, a relation D3+H=D1 is established. That is, at the center between the bolt tightening points 10*a*, a portion H out of the width D1 of the underside end 10*c* of the foot portion is bent up to define a width D3 of the underside of the foot portion. In the area around the bolt tightening point 19*a*, the width D1 of the underside of the foot portion is left unchanged. In other words, the foot portion 10 is not formed with the raised portion 10*b* at the location of the bolt tightening point 10*a*. In the area around the bolt tightening point 10*a*, the foot portion is formed with a projected portion D1−D3=H horizontally projected in the same dimension as the height H of the raised portion 10*b*.

This configuration requires the material of the foot portion before bending to have only a width D1 for defining the same height H as that of the raised portion 10*b* of the first embodiment. In comparison to the first embodiment where the material is required to have the width of D1+H, this embodiment can achieve the reduction of the used amount of material. It is noted that the magnitude of the second moment of area depends upon the height of the raised portion. Hence, the effect to suppress the flexure of the foot portion when the outdoor unit is installed on the stand is the same as that of the first embodiment. The reason for not bending the underside end 10*c* of the foot portion in the area around the bolt tightening point 10*a* or leaving this area unchanged in shape is the same as in the first embodiment or to ensure the efficiency of work of tightening the bolt at the bolt tightening point 10*a*.

A specific example of this embodiment is described. In the case shown in FIG. 7A where the underside end 10*c* of the foot portion is bent in the dimension of the raised portion 10*b* only at the center between the bolt tightening points but not bent in the area around the foot portion 10*a*, the embodiment achieves an effect to further reduce the used amount of material. Specifically, provided that the outdoor unit has a mass of 350 kg, the steel sheet of the foot portion has a thickness of 1.6 mm, and the foot portion has a longitudinal dimension W of 1200 mm, a dimension D1 of 70 mm, an H dimension of 16 mm, and a D3 dimension of 70−16=54 mm, a dimension of D3+H is 70 mm, which is equal to D1. The foot portion exhibits a flexure amount of 2.2 mm while the used amount of the material is reduced. Thus, the embodiment achieves 27 percent improvement over the conventional case shown in FIG. 5.

As described above, this embodiment pertains to the outdoor unit of refrigeration and air conditioning device, which unit includes the heat exchanger accommodated in the housing and the blower disposed atop the housing. The housing includes: the side cover for covering the sides of the unit; the bottom base for covering the bottom of the unit; and the foot portion disposed under the bottom base. The foot portion includes the raised portion formed by bending upward the underside end of the foot portion. The foot portion further includes a plurality of portions fixed to the stand. The foot portion is not formed with the raised portion at the fixed portion, but with the projected portion horizontally projected from the fixed portion substantially in the same dimension as the height of the raised portion. This configuration provides the foot portion capable of ensuring the rigidity while achieving the reduction of the used amount of material.

While the embodiments of the invention have been described above, the invention is not limited to the above-described embodiments but includes a variety of modifications. The above-described embodiments, for example, give a detailed description to clarify the invention but the invention is not necessarily limited to those including all the described components. Further, a part of the configuration of one embodiment is replaceable with a component of another embodiment. A component of one embodiment can be added to the configuration of another embodiment. A part of the configuration of each embodiment permits addition of a component of other configuration, deletion of a component thereof, and replacement with a component of other configuration.

The invention claimed is:

1. A refrigeration and air conditioning device comprising:
an outdoor unit;
a heat exchanger accommodated in a housing of the outdoor unit; and
a blower disposed atop the housing,
wherein the housing includes:
a side cover for covering sides of the outdoor unit;
a bottom base for covering a bottom of the outdoor unit; and
a foot portion disposed under the bottom base having a top portion that engages the bottom base of the outdoor unit and a bottom portion,
wherein the bottom portion of the foot portion includes opposite end portions that are configured to engage a stand and a middle portion extending between the opposite end portions, a raised portion that is unitary with the bottom portion and extends upwardly from the bottom portion along one edge of the bottom portion, wherein the raised portion extends upwardly to terminate below the top portion and has a first height along the middle portion and a second height along the opposite end portions, and wherein the first height is greater than the second height.

2. The refrigeration and air conditioning device according to claim 1, wherein
the opposite end portions of the bottom portion of the foot portion each include a through hole through which fasteners are disposed to fix the foot portion to a stand, and
wherein the raised portion extends upwardly to the second height in an area disposed adjacent to the through holes.

3. The refrigeration and air conditioning device according to claim 1, wherein
the bottom portion of the foot portion has a width dimension and the first height of the raised portion is 60% or less of the width dimension of the bottom portion of the foot portion.

4. The refrigeration and air conditioning device according to claim 2, wherein
the bottom portion of the foot portion has a width dimension and the first height at the mid-point thereof is 60% or less of the width dimension of the bottom portion of the foot portion.

5. A refrigeration and air conditioning device comprising:
an outdoor unit;
a heat exchanger accommodated in a housing of the outdoor unit; and
a blower disposed atop the housing,
wherein the housing includes:
a side cover for covering sides of the outdoor unit;
a bottom base for covering a bottom of the outdoor unit; and
a foot portion disposed under the bottom base having a top portion that engages the bottom base of the outdoor unit and a bottom portion,
wherein the bottom portion of the foot portion includes opposite end portions having a first width that are configured to engage a stand and a middle portion extending between the opposite end portions having a second width, a raised portion that is unitary with the bottom portion and extends upwardly from the bottom portion along one edge of the bottom portion between the opposite end portions and along the middle portion, wherein the raised portion extends upwardly to terminate below the top portion, and wherein the first width at the opposite end portions is wider than the second width of the bottom portion at the opposite end portions.

6. The refrigeration and air conditioning device according to claim 5, wherein
the opposite end portions of the bottom portion of the foot portion each include a through hole through which fasteners are disposed to fix the foot portion to a stand, and
wherein the raised portion extends upwardly to a height dimension approximately equal to a difference in the dimensions of the first and second widths of the bottom portion of the foot portion.

* * * * *